US007895930B2

(12) United States Patent
Fisk et al.

(10) Patent No.: US 7,895,930 B2
(45) Date of Patent: Mar. 1, 2011

(54) WEAPON MOUNT

(75) Inventors: Allan T. Fisk, Needham, MA (US); Hans Hug, Weston, MA (US); Michael T. Johnson, Southborough, MA (US); Nathan R. Desmeule, Bellingham, MA (US)

(73) Assignee: Foster-Miller, Inc., Waltham, MA (US)

( * ) Notice: Subject to any disclaimer, the term of this patent is extended or adjusted under 35 U.S.C. 154(b) by 1073 days.

(21) Appl. No.: 11/656,864

(22) Filed: Jan. 23, 2007

(65) Prior Publication Data

US 2010/0269679 A1 Oct. 28, 2010

(51) Int. Cl.
*B64D 1/04* (2006.01)

(52) U.S. Cl. ..... 89/1.1; 89/1.13; 102/402; 901/19; 42/94

(58) Field of Classification Search ..... 89/1.1, 89/1.13; 102/402; 901/19–26; 42/94
See application file for complete search history.

(56) References Cited

U.S. PATENT DOCUMENTS 4,621,562 A * 11/1986 Carr et al. ..... 89/41.05
4,773,298 A * 9/1988 Tischer et al. ..... 89/1.13
4,932,831 A 6/1990 White et al.
4,993,912 A * 2/1991 King et al. ..... 414/729
5,022,812 A 6/1991 Coughlan et al.
5,201,239 A * 4/1993 Bundo et al. ..... 74/479.01
5,353,681 A 10/1994 Sugg
5,570,992 A * 11/1996 Lemelson ..... 414/744.3
5,647,554 A * 7/1997 Ikegami et al. ..... 242/390.9
5,934,141 A * 8/1999 Costa ..... 74/89.17
6,113,343 A * 9/2000 Goldenberg et al. ..... 414/729
6,264,419 B1 * 7/2001 Schinzel ..... 414/751.1
6,408,531 B1 * 6/2002 Schimmels ..... 33/644
6,535,793 B2 3/2003 Allard
6,578,464 B2 6/2003 Ebersole, Jr. et al.
6,745,663 B2 6/2004 Ebersole, Jr. et al.
6,789,456 B2 9/2004 DeRoos et al.
6,860,206 B1 3/2005 Rudakevych et al.
6,889,594 B2 5/2005 Ebersole, Jr. et al.
7,143,696 B2 12/2006 Rudakevych et al.
7,836,811 B1 * 11/2010 Gardner et al. ..... 89/40.04
2003/0154851 A1 * 8/2003 Ebersole et al. ..... 89/42.01
2003/0200862 A1 * 10/2003 Ebersole et al. ..... 89/42.01
2004/0216932 A1 11/2004 Giovanetti et al.
2007/0193790 A1 * 8/2007 Goldenberg et al. ..... 180/9.1

(Continued)

OTHER PUBLICATIONS

AB Precision (Poole) Ltd, 1 Fleets Lane, Poole, Dorset, BH15 3BZ, United Kingdom, On-Line Catalog from website http://www.abprecision.co.uk, Jan. 19, 2007.

(Continued)

*Primary Examiner*—Troy Chambers
*Assistant Examiner*—Samir Abdosh
(74) *Attorney, Agent, or Firm*—Iandiorio Teska & Coleman

(57) ABSTRACT

A mobile remotely controlled robot includes a robot platform and a robot arm maneuverable with respect to the robot platform. A housing is configured to be removably mounted to the robot arm. A sleeve is translatable with respect to the housing for receiving a weapon therein. There is a gear rack on the sleeve and a pinion gear, rotatably disposed in the housing, is engaged with the gear rack. A braking subsystem resists rotation of the pinion gear when the gear rack translates upon firing of the weapon.

10 Claims, 15 Drawing Sheets

U.S. PATENT DOCUMENTS

| | | | | |
|---|---|---|---|---|
| 2007/0261689 | A1* | 11/2007 | Tai et al. | 124/67 |
| 2008/0121097 | A1* | 5/2008 | Rudakevych et al. | 89/28.05 |
| 2009/0223355 | A1* | 9/2009 | Manders | 89/1.13 |
| 2010/0212482 | A1* | 8/2010 | Morin et al. | 89/27.11 |
| 2010/0263524 | A1* | 10/2010 | Morin et al. | 89/27.12 |
| 2010/0263948 | A1* | 10/2010 | Couture et al. | 180/8.2 |

OTHER PUBLICATIONS

Proparms Ltd., 2930 Chemin Ste-Therese, Carignan, QC, Canada J3L 2B2, On-Line Catalog from website http://www.proparms.com Jan. 19, 2007.

U.S. Appl. No. 11/543,427, filed Oct. 10, 2006, Deguire et al.

Northrop Grumman Remotec ANDROS F6A Heavy Duty Robot, http://www.es.northropgrumman.com/remotec/f6a.htm (1pg).

Northrop Grumman Electronic Systems-Accessories for Remotec ANDROS F6A, http://www.es.northropgrumman.com/remotec/details/f6a_accessories.htm (2pgs).

Northrop Grumman Remotec ANDROS F6A Heavy Duty Robot, http://www.es.northropgrumman.com/remotec/details/f6a_specs.htm (2pgs).

Northrop Grumman Remotec ANDROS F6A Heavy Duty Robot, http://www.es.northropgrumman.com/remotec/wolverine.htm (1pg).

Northrop Grumman Electronic Systems-Remotec ANDROS Wolverine Accessories, http://www.es.northropgrumman.com/remotec/details/wolverine_accessories.htm (2pgs).

Northrop Grumman Remotec ANDROS Mark V-A1 Hazardous Duty Robot, http://www.es.northropgrumman.com/remotec/markval.htm (2pgs).

Northrop Grumman Electronic Systems-Remotec-Law Enforcement, SWAT Application, http://www.es.northropgrumman.com/remotec/law_enforcement_swat.htm (2pgs).

Battelle, Law Enforcement Robot Technology Assessment, TWSWG Task T-150B2, Apr. 2000 (87pgs).

* cited by examiner

WEAPON MOUNT

FIELD OF THE INVENTION

This subject invention relates to weapons, in one example a disrupter; to mobile remotely controlled robots; and to weapon mounts.

BACKGROUND OF THE INVENTION

Disruptors are used to disarm or render inoperable an explosive. Typically, the disruptors are fired from a remote location. Personnel typically set up a stand near an explosive device and attach the disruptor to the stand so it is aimed at the explosive. The disruptor is then fired from a remote, safe location.

It is also known to equip a mobile remotely controlled robot with a disruptor. That way, personnel need not ever position themselves too close to the explosive device. Typically, the disruptor is mounted to a manipulatable arm of the robot so the disruptor can be correctly aimed and positioned. But, the robot arm is often susceptible to damage caused by the shock force produced by the recoil of the disruptor when fired.

Various recoil mitigation techniques have been tried. U.S. Pat. Nos. 6,889,594; 6,745,663; and 6,578,464 (incorporated herein by this reference), for example, disclose a brake attached to the disruptor barrel and frictionally received in a guide tube fixed to a support frame or a robot.

With some munitions, such a recoil mitigation system may not adequately arrest the weapon. With some clamping friction designs, the barrel of the robot, upon firing, can itself fly out of its mount and become a rearward projectile. Or, the robot or its components may be damaged if too much frictional force is applied. The assignee hereof also provided a prior disruptor mount in an attempt to mitigate recoil via frictional forces. The amount of friction, however, was not readily adjustable, was not repeatable due to wear and/or intolerances, and the set value of the frictional force was difficult to determine by the user.

Breech vent recoil mitigation techniques may rob the weapon of performance and reduce the muzzle velocity of the projectile used. Various shock absorber techniques proved to be costly, heavy, and difficult to implement due to the preference to accommodate a long stroke of the disruptor barrel.

SUMMARY OF THE INVENTION

It is therefore an object of this invention to provide a new weapon mount for a robot or for a weapon stand.

It is a further object of this invention to provide such a weapon mount which adequately mitigates recoil of the weapon.

It is a further object of this invention to provide such a weapon mount which prevents damage to the robot and/or components of the robot or weapon.

It is a further object of this invention to provide such a weapon mount which does not adversely affect the performance of the weapon.

It is a further object of this invention to provide such a weapon mount in which the amount of braking force is readily adjustable and can be repeatably set to pre-determined values.

It is a further object of this invention to provide such a weapon mount which is more universal in design and able to accommodate different weapons from different manufacturers.

The subject invention results from the realization that a better recoil mitigation weapon mount for a robot includes an arrestor subsystem configured to translate the linear motion of the weapon when fired into rotary motion which is then more easily resisted in some fashion. An exemplary arrestor subsystem includes a gear rack fixed with respect to the weapon, a rotatable pinion gear in engagement with the gear rack, and a brake mechanism which resists rotation of the pinion gear when the gear rack translates upon firing of the weapon.

The subject invention, however, in other embodiments, need not achieve all these objectives and the claims hereof should not be limited to structures or methods capable of achieving these objectives.

The subject invention features a mobile remotely controlled robot. A robot arm is maneuverable with respect to a robot platform. A housing is configured to be removably mounted to the robot arm. A sleeve is translatable with respect to the housing and receives a weapon therein. There is a gear rack on the sleeve and a pinion gear rotatably disposed in the housing and engaged with the gear rack. A braking subsystem resists rotation of the pinion gear when the gear rack translates upon firing of the weapon.

In one example, the housing includes a channel therethrough which receives the sleeve and the gear rack. The housing may also include a clamping mechanism securable to the robot arm.

One typical braking subsystem includes a shaft fixed to the pinion gear and rotatable with respect to the housing, a brake disk fixed to the housing, a brake hub fixed to the shaft and having a shoe portion adjacent one side of the brake disk, and a translatable brake shoe adjacent an opposite side of the brake disk. There are also means for biasing the translatable brake shoe. There may optionally be a first brake pad between the shoe portion of the brake hub and the brake disk and a second brake pad between the translatable brake shoe and the brake disk. In one embodiment, the means for biasing includes a plurality of Belleville springs about the brake hub adjacent the translatable brake shoe and a nut securable to the brake hub adjustable to bear upon the Belleville springs.

Also included may be an indicator ring settable with respect to the translatable brake shoe to mark the position of the nut on the brake hub. Further included may be means for disengaging the pinion gear from the gear rack. In one example, the means for disengaging includes a carrier for the brake disk, and a mechanism such as a pin for locking the carrier with respect to the housing.

The subject invention also features a weapon mount comprising a housing through which the weapon translates when fired, a conversion subsystem configured to convert translation of the weapon when fired into rotational motion, and a braking subsystem for resisting rotation of the conversion subsystem. Such a weapon mount can be used with a disruptor or other firearm and can be mounted to a robot or other structure.

In one example, the conversion subsystem included a gear rack fixed with respect to the weapon and a gear in the housing in engagement with the gear rack. The typical braking subsystem includes a shaft fixed to the pinion gear and rotatable with respect to the housing, a brake disk, a shoe portion fixed to the shaft and adjacent one side of the brake disk, a translatable brake shoe adjacent on opposite side of the brake disk, and means for biasing the translatable brake shoe.

In another example, the conversion subsystem includes a cable fixed on opposite ends with respect to the weapon and wrapped about a drum rotatably disposed in the housing. Then, a typical braking subsystem includes a brake disk fixed to the housing, a shaft fixed to the drum and rotatable with respect to the housing, a brake shoe on the shaft, and a friction brake for biasing the brake shoe against the brake disk. The braking subsystem may further include a one way roller clutch between the drum and the shaft. Also there may be a spring on the shaft.

One weapon mount in accordance with this invention includes a housing configured to be removably mounted to a robot arm, a sleeve translatable through the housing for receiving a weapon therein, a gear rack on the sleeve, a gear rotatably disposed in the housing and engaged with the gear rack, an adjustable friction brake subsystem for resisting rotation of the gear when the gear rack translates upon firing of the weapon, and means for disengaging the gear from the gear rack to translate the weapon with respect to the housing when desired.

One recoil mitigation weapon mount in accordance with this invention features a housing through which a weapon is translatable when fired, a gear rack which translates with the weapon, a gear rotatably disposed in the housing and engaged with the gear rack, and a braking subsystem for resisting rotation of the gear.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
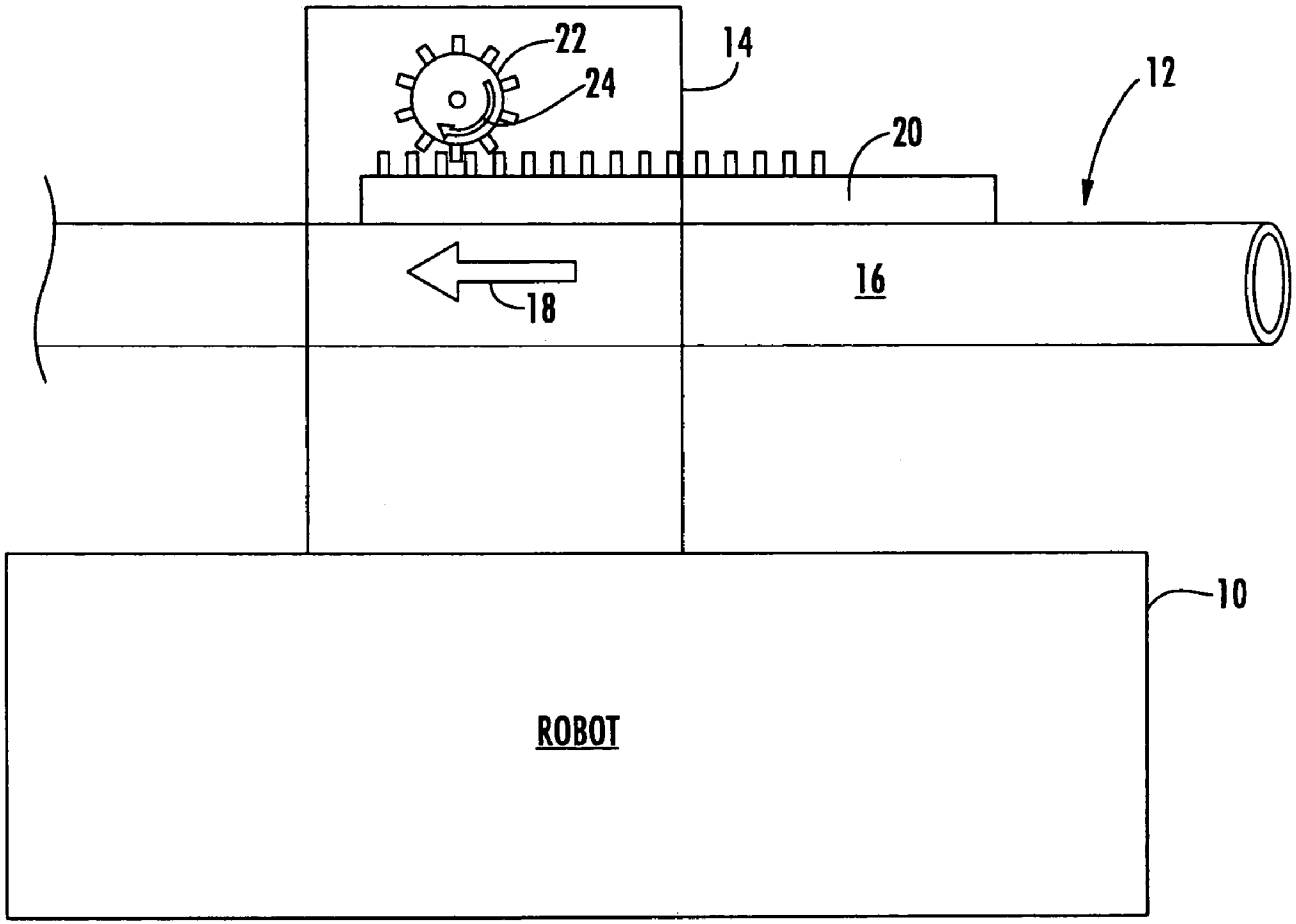
FIG. 1 is a highly schematic cross-sectional side view showing an example of a weapon mount in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 schematically shows robot 10 (e.g., a remotely controlled mobile "Talon" robot (Foster-Miller, Inc., Waltham, Mass.) with weapon 12 mounted thereto, for example a disruptor. Other robot platforms are possible in accordance with the subject invention. See, for example, U.S. Pat. Nos. 4,621,562; 6,113,343; and U.S. Patent Publication No. 2004/0216932 all incorporated herein by this reference. Weapon 12 may also be a shotgun or other firearm.

Housing 14 is configured to secure barrel 16 of weapon 12 to robot 10 but in a fashion such that barrel 16 can translate in the direction of arrow 18 upon firing.

In accordance with the subject invention, an arrestor subsystem is configured to translate this linear motion into rotary motion which is resisted (e.g., braked) in some fashion. In one particular example, the arrestor subsystem includes gear rack 20 fixed with respect to barrel 16 and also translatable along with barrel 16 through housing 14 in the direction of arrow 18 when weapon 12 is fired.

A gear such as pinion gear 22 is rotatably attached to housing 14 and therefore fixed in translation with respect to robot 10. Gear 22 is in engagement with gear rack 20 as shown. Thus, when weapon 12 is fired, gear rack 20 translates in the direction shown by arrow 18 and gear 22 turns in the direction of arrow 24. A braking mechanism, such as a spring loaded friction brake, is included to resist rotation of gear 22 typically via its shaft.

Figure 2:
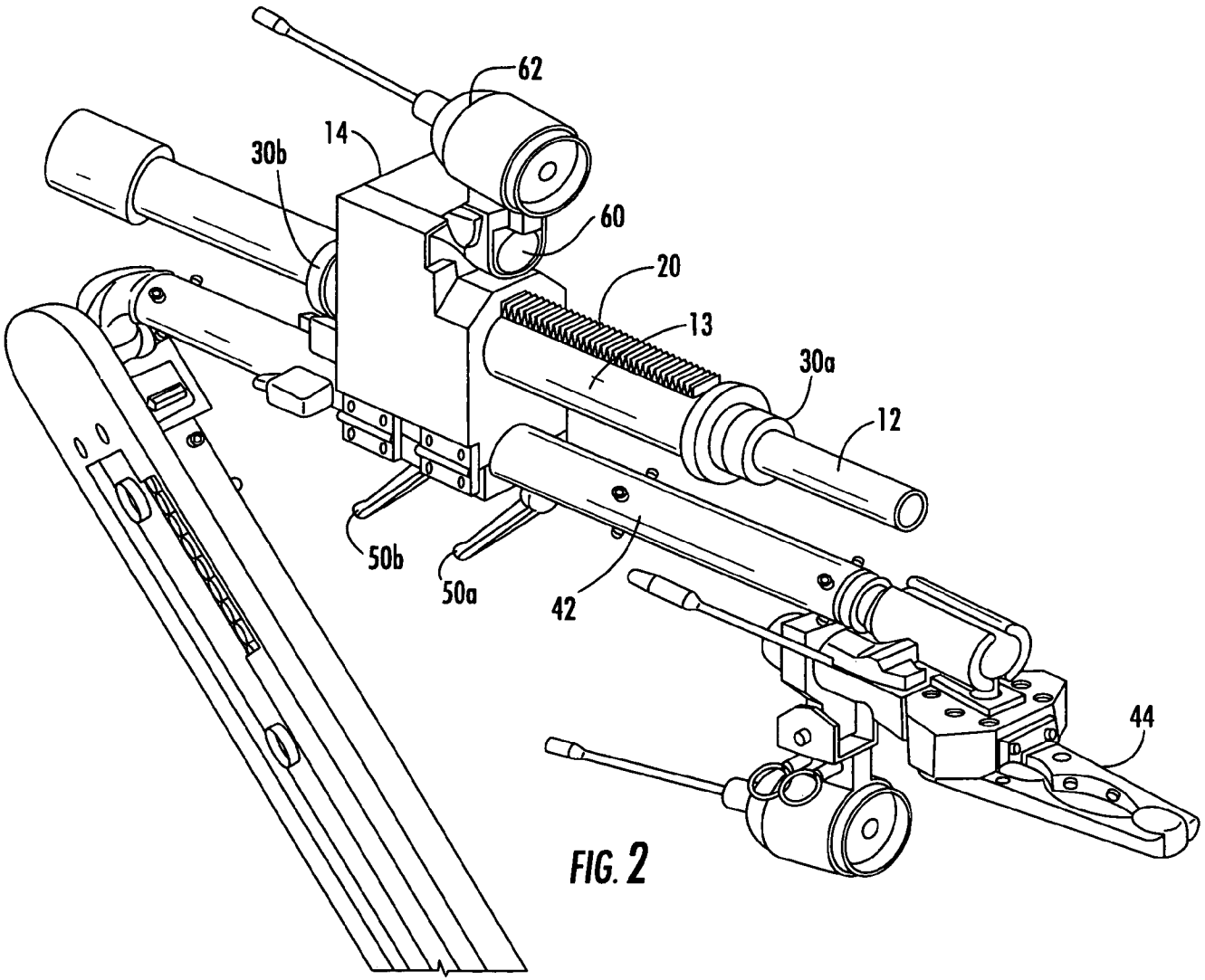
FIG. 2 is a schematic three-dimensional view showing an example of a weapon mount removably secured to a manipulatable robot arm in accordance with the subject invention.

In one example, housing 14, FIG. 2 includes an orifice therethrough which receives sleeve 13 which has gear rack 20 secured thereto. Weapon barrel 12 is secured to sleeve 13 via one or more clamps 30*a* and 30*b*. In this way, weapons of different configurations can be used with housing 14. Housing 14 is removably securable to articulating robot arm portion 42 via clamping mechanisms 50*a* and 50*b*. Robot arm portion 42 also includes, inter alia, end effector 44. Housing 14 also preferably includes mount 60 for camera 62. When barrel 12 and sleeve 13 translate rearward in FIG. 2 after firing, end effector 44 can be used without obstruction from barrel 12 as maneuverable robot arm portion 40 is remotely operated. The firing circuitry of U.S. patent application Ser. No. 11/543,427, incorporated herein by this reference, can be employed to initiate firing of the weapon.

Figure 3A:
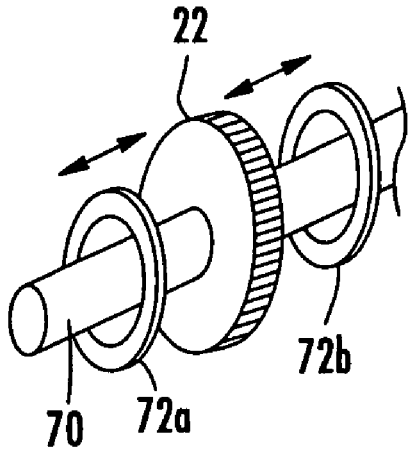
FIG. 3A is a highly schematic three-dimensional view showing one example of a braking mechanism in accordance with the subject invention.
Figure 3B:
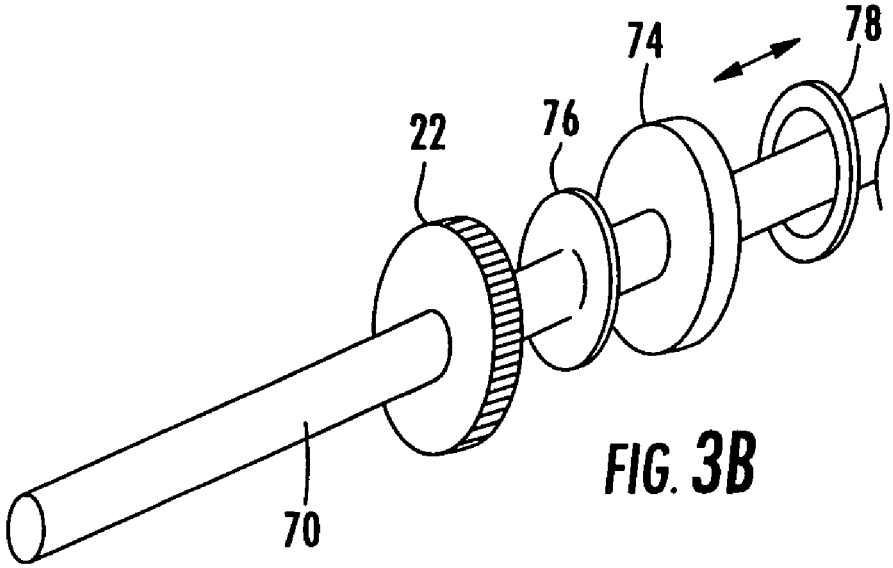
FIG. 3B is a schematic three-dimensional view showing another example of a braking mechanism in accordance with the subject invention.

Inside housing 14 is, in one embodiment, pinion gear 22, FIG. 3A, rotatably disposed with respect to the housing via shaft 70. Brake pads 72*a* and 72*b* are biased in some fashion against pinion gear 22 or some other structure associated with shaft 70. In another example, brake disk 74, FIG. 3B is fixed to the housing between brake shoe 76 on shaft 70 and movable brake shoe 78. Movable brake shoe 78 is biased in some fashion against brake disk 74 itself biased against brake shoe 76.

Figure 4:
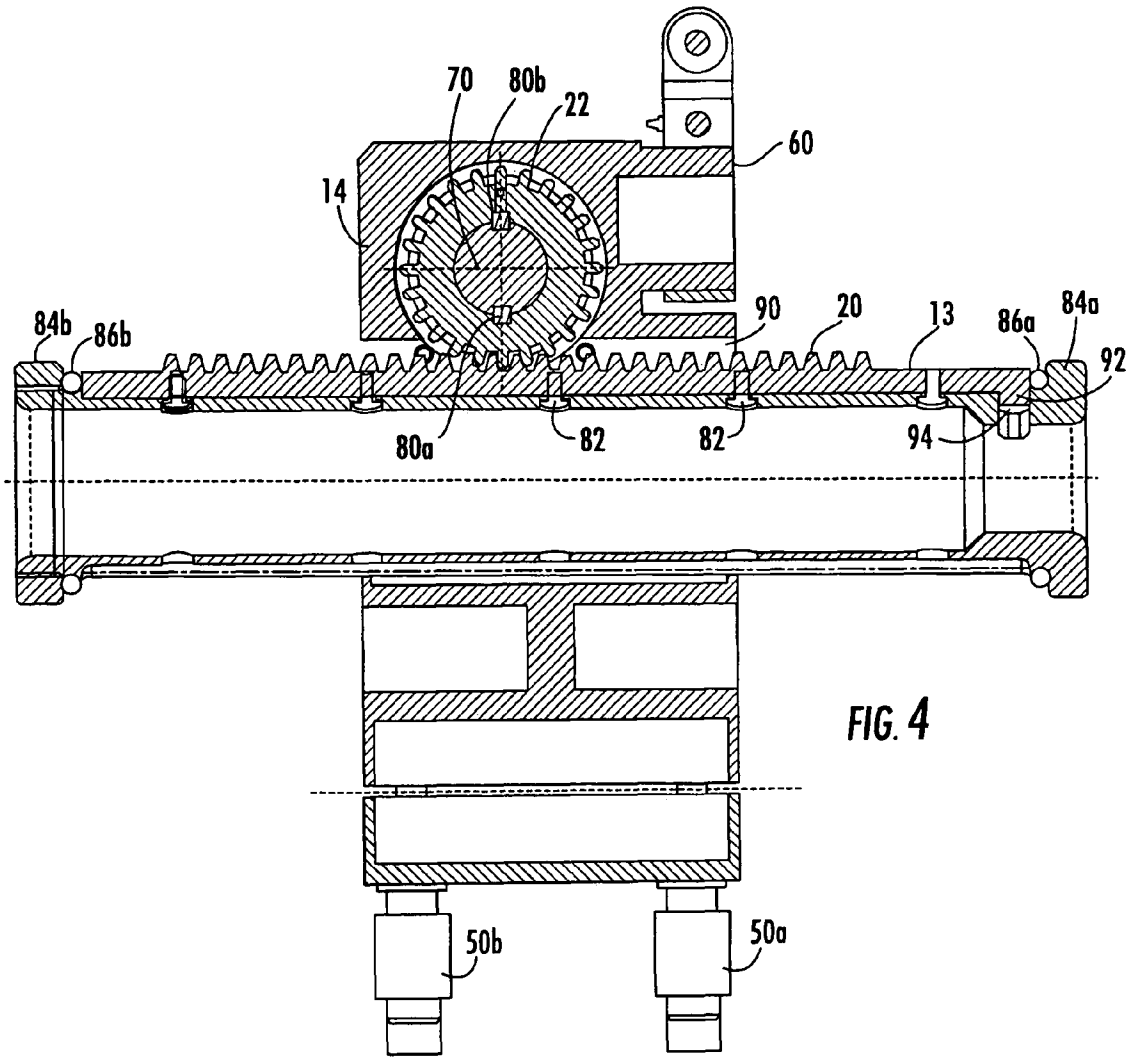
FIG. 4 is a schematic cross-sectional side view of a preferred recoil mitigation disruptor mount in accordance with the subject invention.
Figure 5:
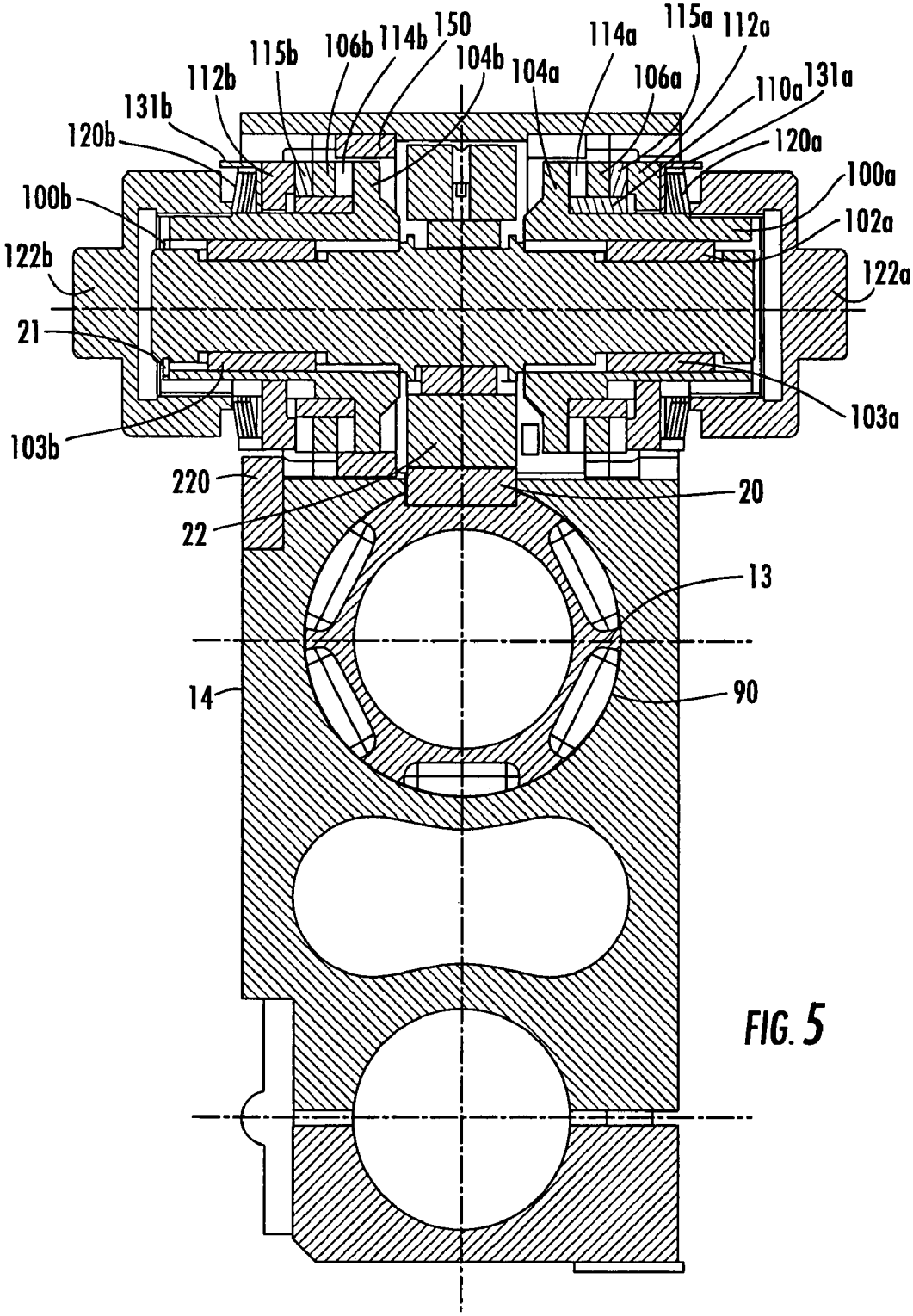
FIG. 5 is a schematic cross-sectional front view of the disruptor mount shown in FIG. 4.

In one preferred example shown in FIGS. 4-5, pinion gear 22 is locked to shaft 70 via keys 80*a* and 80*b*. Gear rack 20 is fixed to sleeve 13 via fasteners 82. Sleeve 13 includes collars 84*a* and 84*b*. Collar 84*b* is removable in order to insert sleeve 13 in through channel 90 in housing 14. O-rings 86*a* and 86*b* between collars 84*a* and 84*b*, respectively, cushion the motion of sleeve 13 in housing 14 with respect to the collars.

Tab 92 on gear rack 20 is received in indent 94 in sleeve 13 to absorb any axial force borne between gear rack 20 and sleeve 13.

The preferred braking subsystem is shown in FIG. 5. When pinion gear 22 rotates due to translation of gear rack 20 on sleeve 13, shaft 70 also rotates. Focusing on the brake subsystem on the right in FIG. 5, brake hub 100*a* is slidably keyed to shaft 70 via keys 102*a* and 103*a*. The keyways in brake hub 100*a* are longer than keys 102*a* and 103*a* in order to disengage gear 22 from gear rack 20 as discussed below. Brake hub 100*a* includes shoe portion 104*a* adjacent one side of brake disk 106*a*. Brake disk 106*a* is secured to housing 14 and, in conjunction with bushing 110*a*, also serves as a bearing for one end of shaft 70. On the opposite side of brake disk 106*a* is translatable brake shoe 112*a* which is slidably splined to brake hub 100*a*.

Brake pad 114*a* may be disposed between brake shoe portion 104*a* of brake hub 100*a* and brake disk 106*a*. Similarly, brake pad 115*a* may be disposed between translatable brake shoe 112*a* and brake disk 106*a*. There are means for biasing translatable brake shoe 112*a* against pad 115*a* itself then biased against brake disk 106*a*.

In this embodiment, Belleville spring set 120*a* (e.g., 4 Belleville washers) are disposed about brake hub 100*a* and nut 122*a* is threaded onto brake hub 100*a* and is adjustable thereon to urge Belleville spring set 120*a* against translatable brake shoe 112*a*. Thus, brake shoe portions 104*a* and 112*a* of brake hub 100*a* are arrested against rotation by the compressive force of Belleville spring set 120*a* which squeezes brake pads 114*a* and 115*a* against opposing sides of fixed brake disk 106*a*. The amount of braking force is adjustable by turning nut 122*a*. Bushing 110*a* positions brake pads 114*a* and 115*a* and brake disk 106*a* and floats with respect to brake hub 100*a*. Other designs for spring loaded adjustable friction brakes are possible as those familiar with the art will recognize. The preferred example shown in FIGS. 4 and 5 is able to utilize commercially available brakes. For instance, the preferred braking subsystem described in FIG. 5 is adapted from standard model FC-50 by Ringfeder Corp.

FIG. 5 also shows tab 131*a* on indicator ring 130*a* which is rotationally settable with respect to translatable brake shoe 112*a* to mark a "zero" position on brake hub 100*a* with respect to engraved numbers on nut 122*a*. In this way, the operator can set or reset, at any time, the correct force exerted by the Belleville spring set 120*a* on translatable brake shoe 112*a*.

Also, after firing, when sleeve 13 and weapon 12 have been braked to a stop in a rearward position, gear 22 can be disengaged from gear rack 20 and yet the spring setting from the previous firing via tab 131*a* on indicator ring 130*a* is retained. The left hand side of FIG. 5 shows carrier 150 for brake disk 106*b* which allows brake disk 106*b*, hence entire left hand side brake assembly, shaft 70, and gear 22, to be slid outwardly from housing 14 as discussed below for disengaging gear 22 from gear rack 20. Carrier 150 is slidably but anti-rotationally engaged with housing 14. Otherwise, the braking subsystem on the left hand side of FIG. 5 is typically the same as or similar to the braking subsystem discussed above with respect to the right hand portion of FIG. 5 and thus the left hand side is marked with the same reference numbers save the letter b as opposed to the letter a.

Figure 6:
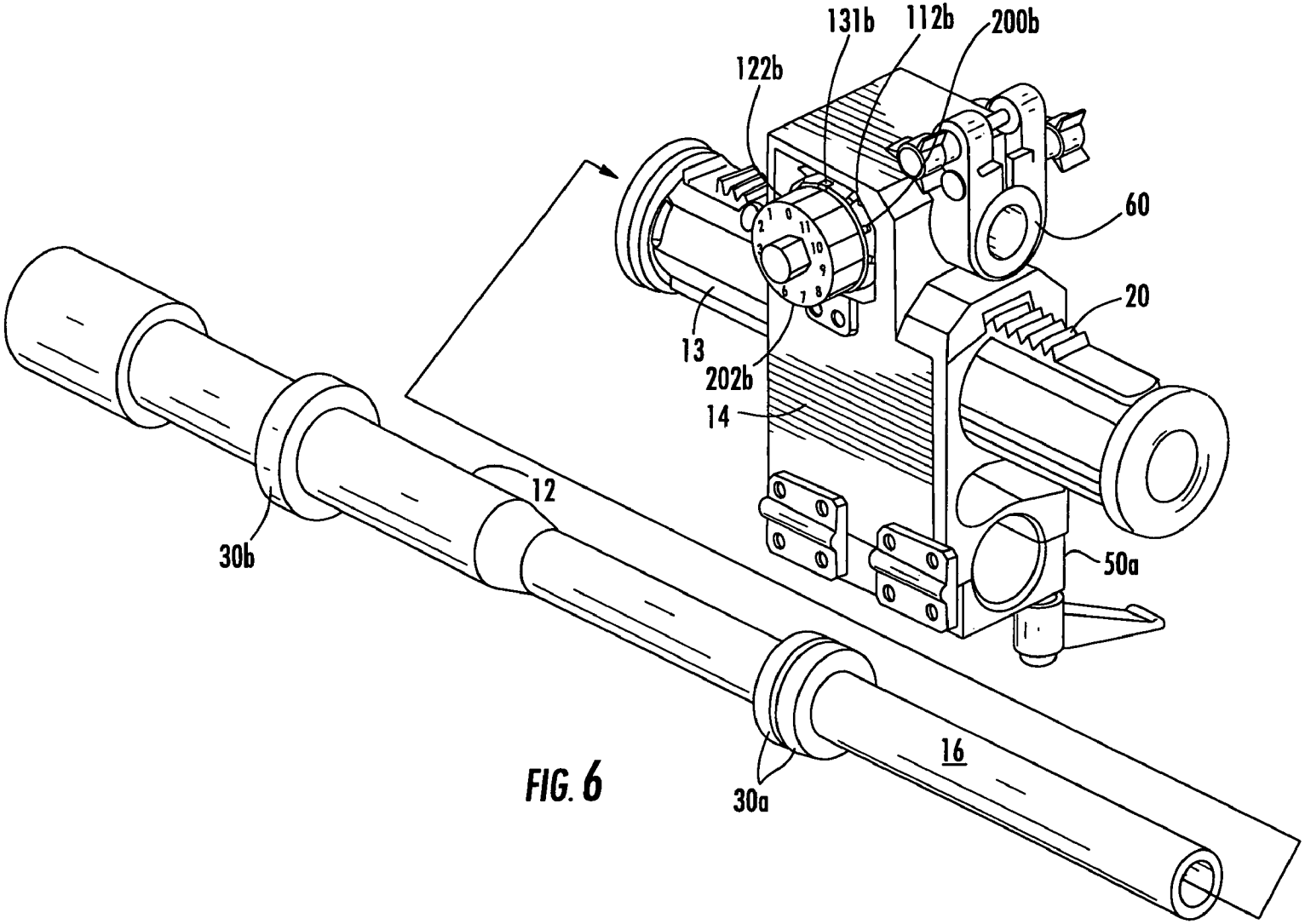
FIG. 6 is a schematic three-dimensional view showing an example of a disruptor mount in accordance with the subject invention.

FIG. 6 shows weapon barrel 16 with collars 30*a* (one or more) and 30*b*. In some designs, the barrel includes a flange and collar 30*b* is not required. Nut 122*b* is shown as is translatable brake shoe 112*b* with slots 200*b* therein for tab 131*b* on indicator 130*b* (slots 200*a* are not visible in FIG. 5). Nut 122*b* includes indicia 202*b* such as numbers for ascertaining the setting of springs against translatable brake shoe 112*b* via tab 131*b* on indicator 130*b*. In this way, the braking subsystem is both adjustable and settable.

Figure 7:
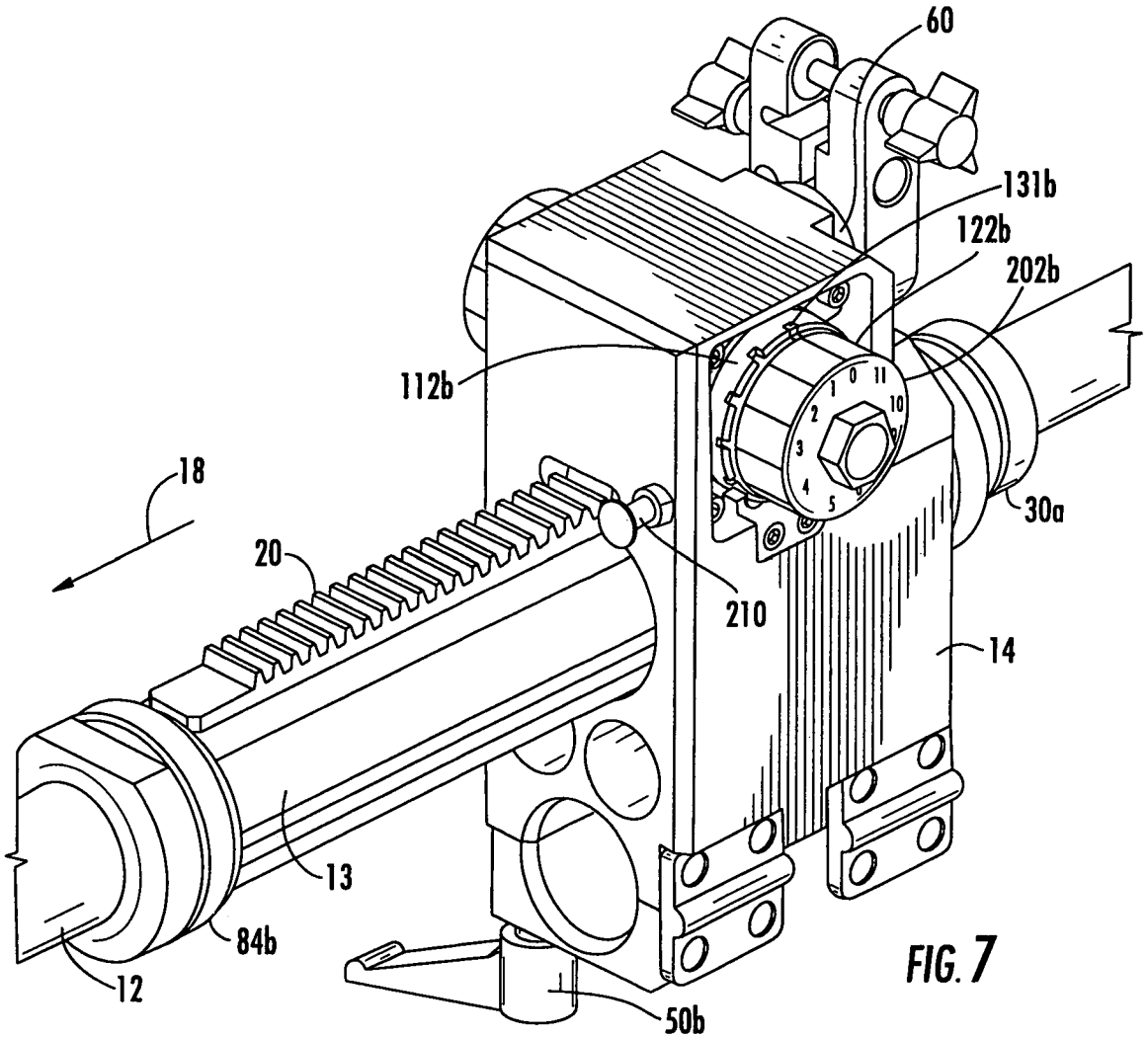
FIG. 7 is a schematic three-dimensional view showing the opposite side of the disruptor mount shown in FIG. 6.
Figure 8:
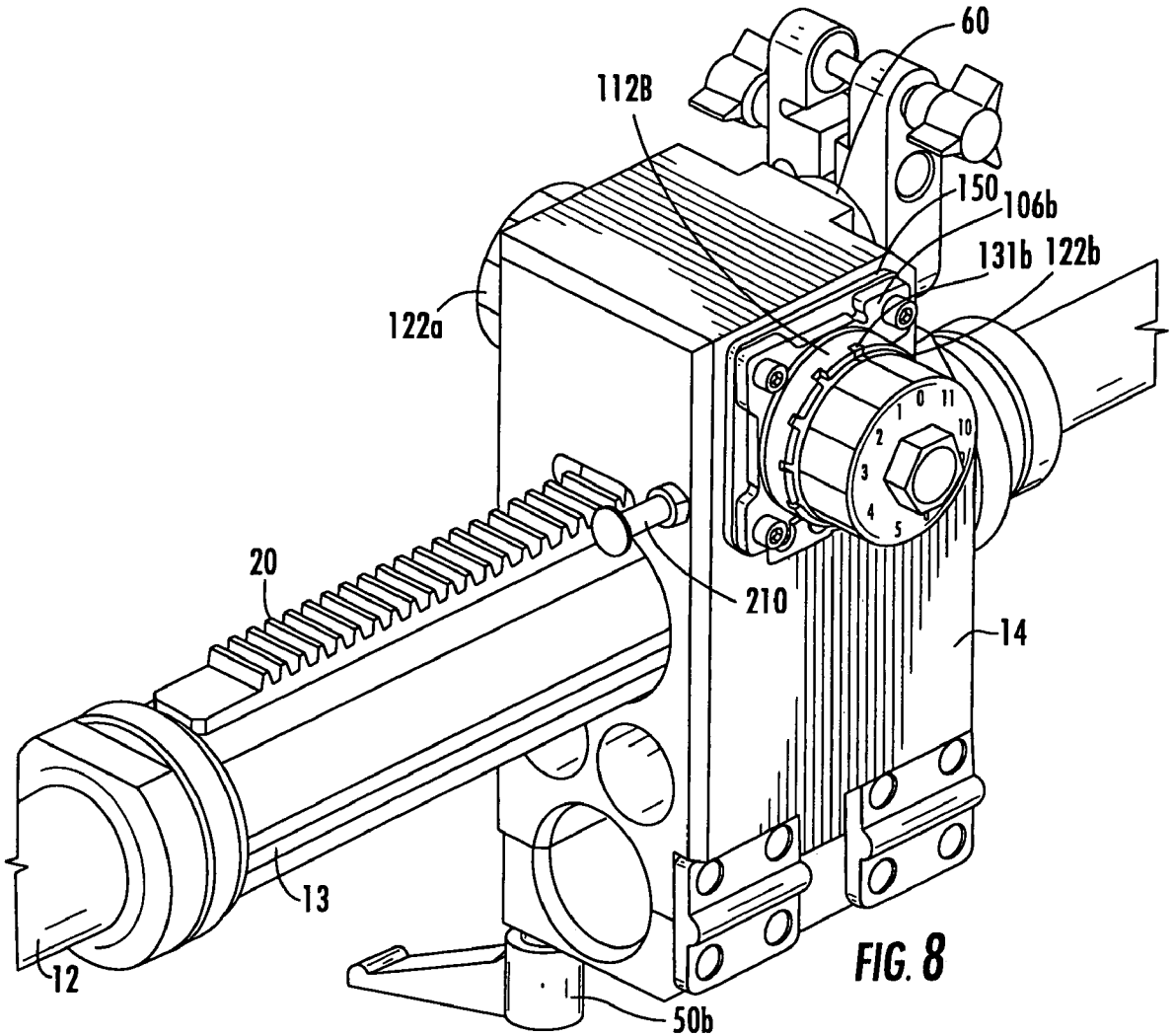
FIG. 8 is another schematic three-dimensional side view showing the disruptor mount of FIG. 8.

FIG. 7 shows nut 122*b* also with indicia 202*b*. Translatable braking shoe 112*b* is also shown. Weapon 12 in FIG. 7 has been fired and sleeve 13 has recoiled in direction of arrow 18. To reset sleeve 13, pin 210 is pulled to free brake disk 106*b* carrier 150, FIG. 8. Now, nut 122*b*, brake hub 100*b*, which is affixed to shaft 70 by snap ring 71, translatable brake shoe 112*b*, brake disk 106*b* and carrier 150 attached thereto, shaft 70, and gear 22 can be slid partially out of housing 14 as shown in FIG. 8. This action moves shaft 70, FIG. 5 to the left in FIG. 5 and as a result gear 22 is no longer engaged with the teeth of gear rack 20. In this way, sleeve 13 is more easily slid to the right in FIG. 8 for reloading. At the same time, the settings 120*a* and 120*b* of indicator rings 130*a* and 130*b*, FIG. 5 and the biasing force provided by the Belleville springs 120*a* and 120*b* via nuts 122*a* and 122*b* and translatable brake shoes 112*a* and 112*b* remain set to the same configuration before firing. When sleeve 13 is reset forward in housing 14, nut 122*b* and the attached components are slidably pushed back into housing 14 whereupon pin 210 locks carrier 150 into position.

Figure 9:
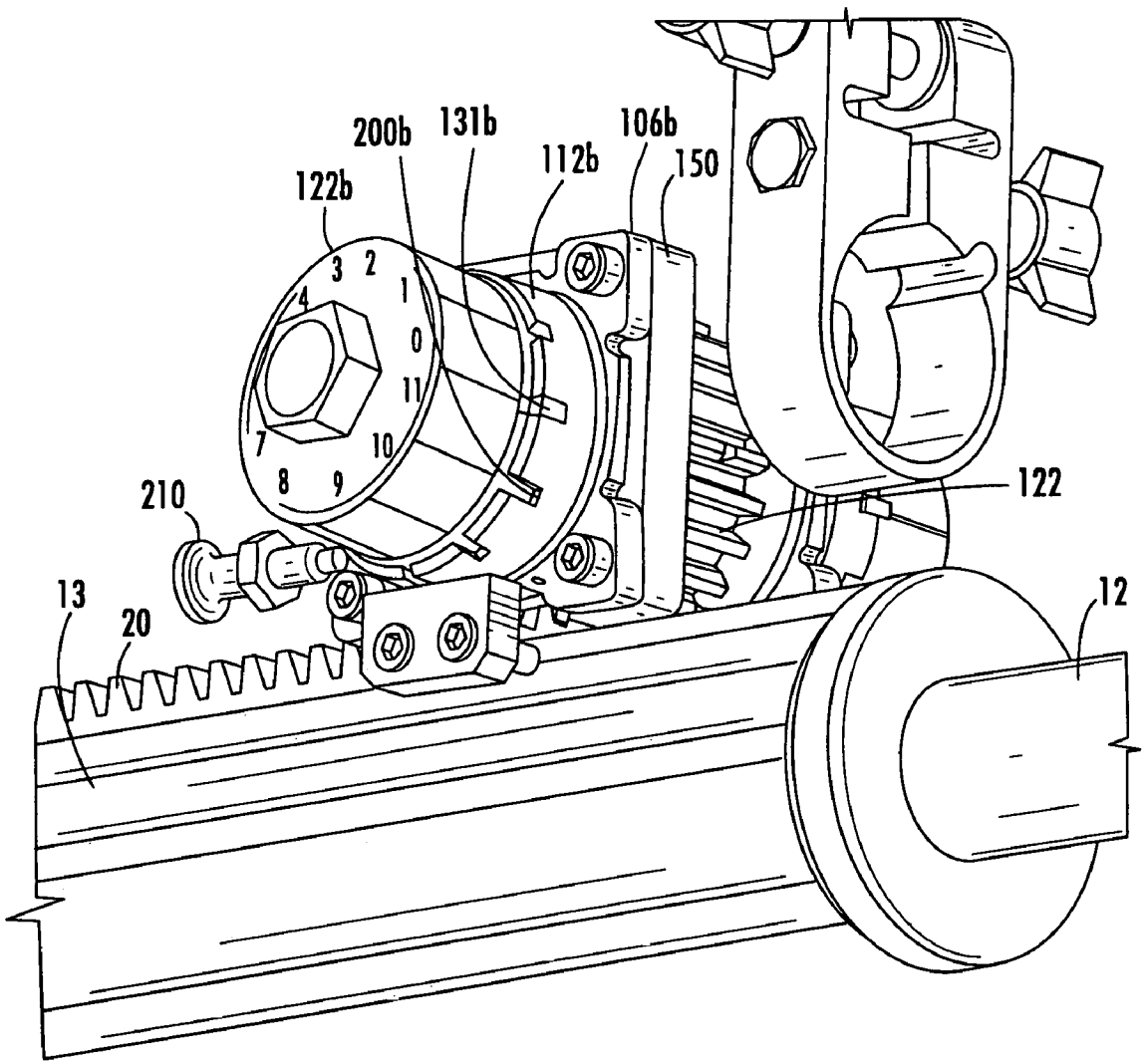
FIGS. 9-14 are schematic three-dimensional partial views showing the primary components associated with the disruptor mount shown in FIGS. 6-8 and showing, in sequence, how the weapon is repositioned after firing.
Figure 10:
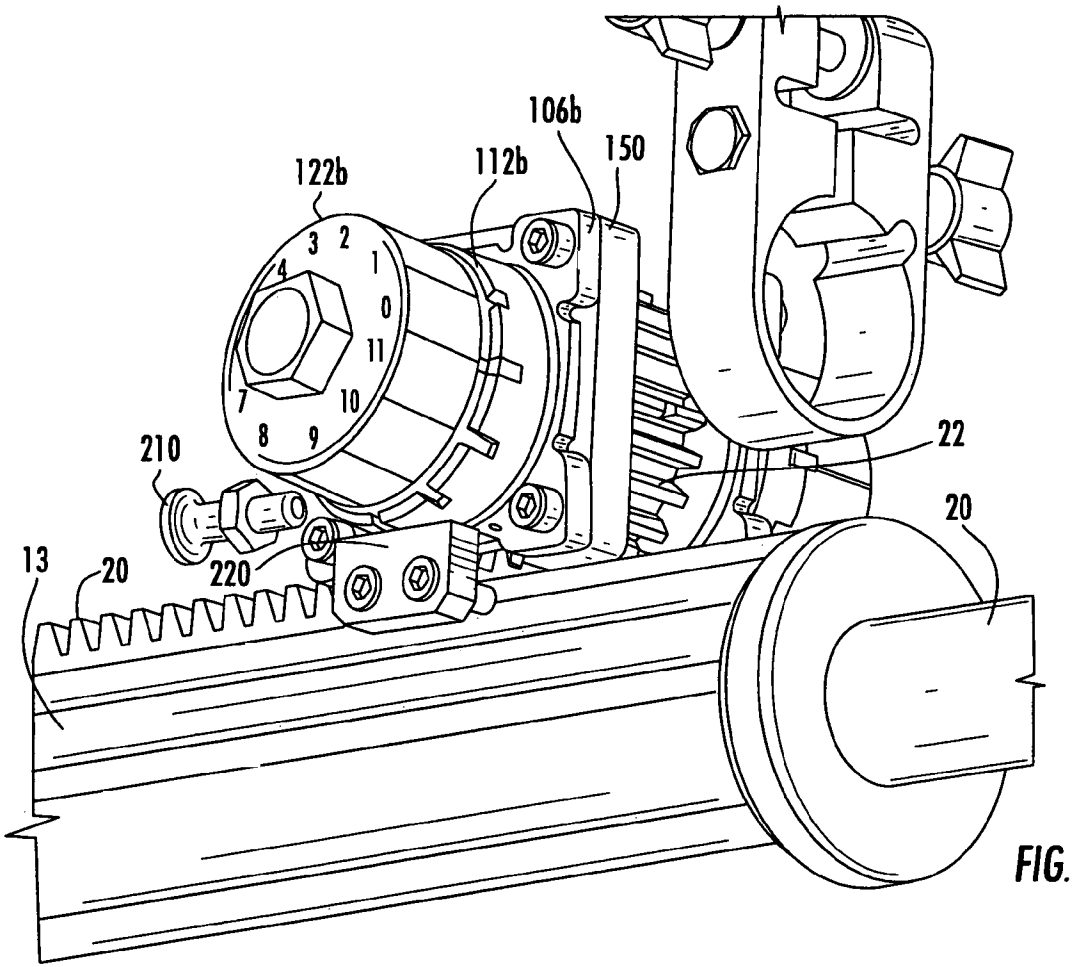
Figure 11:
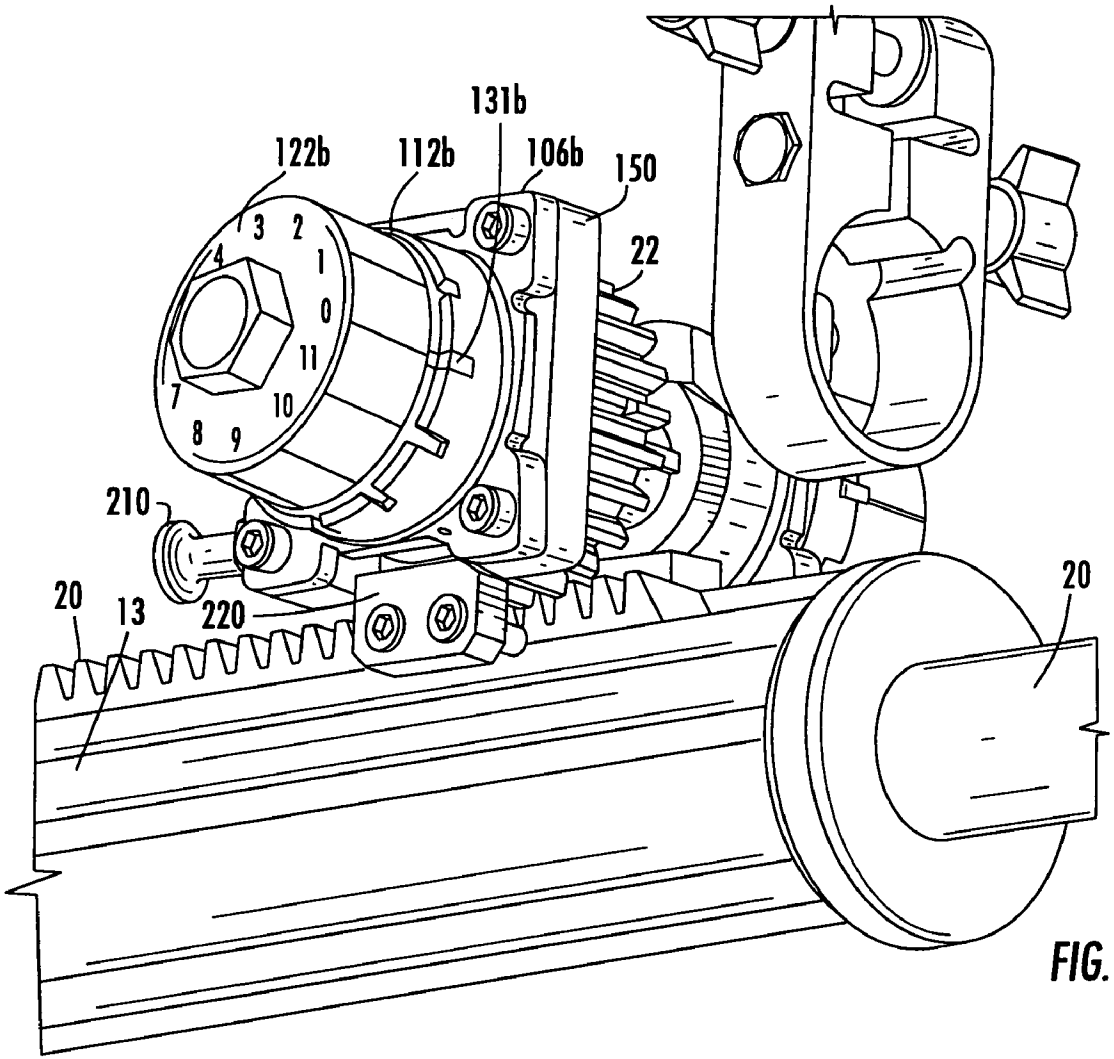
Figure 12:
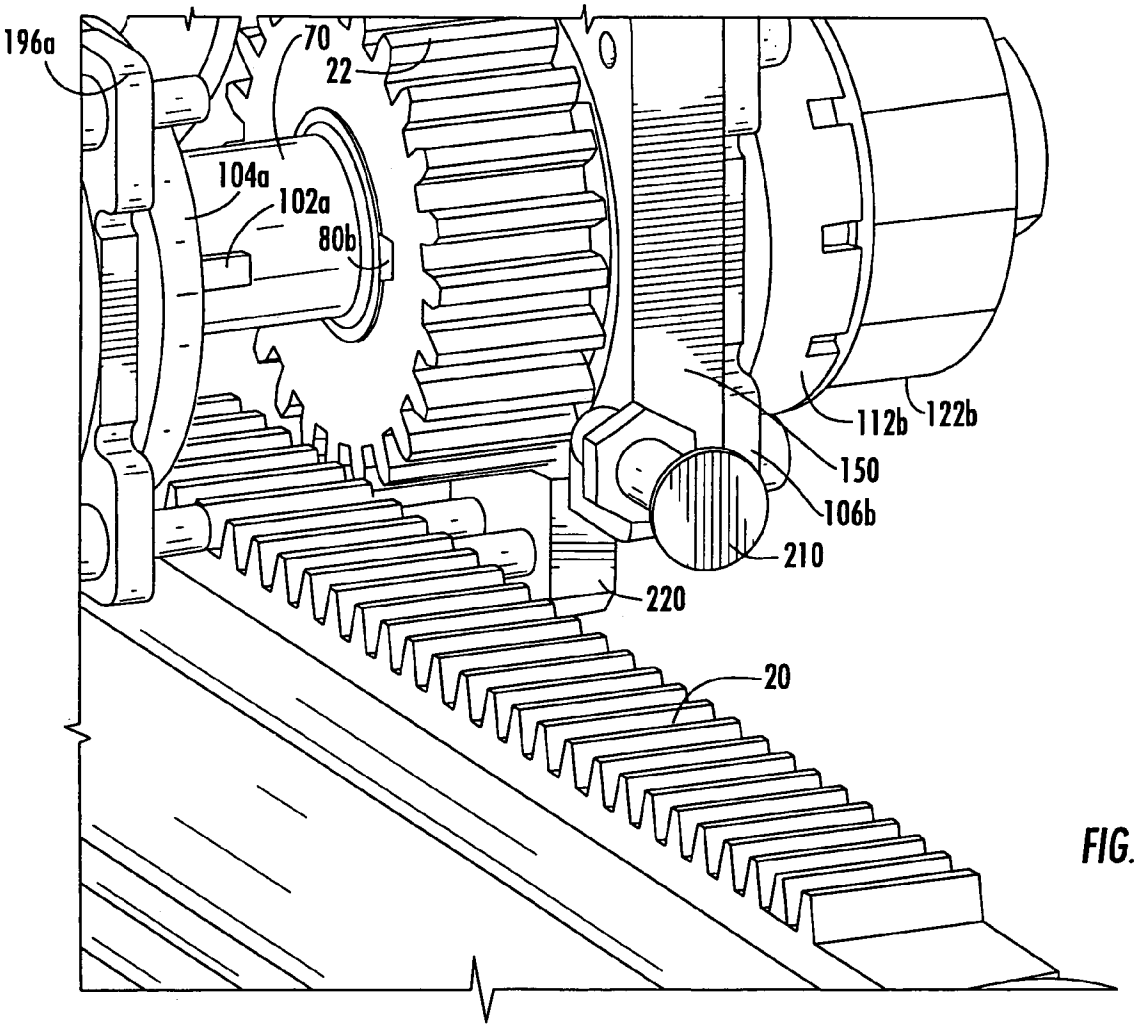
Figure 13:
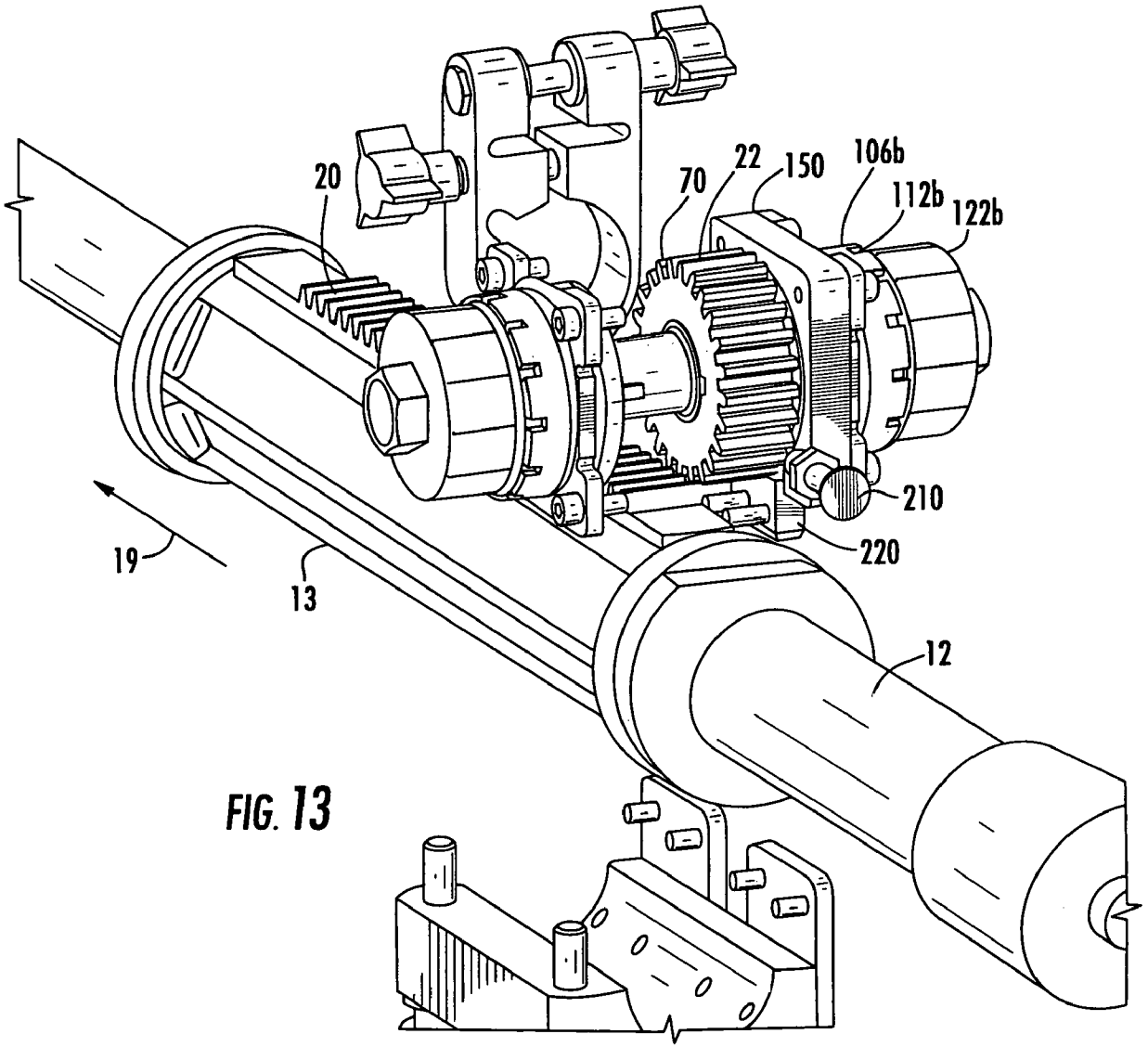
Figure 14:
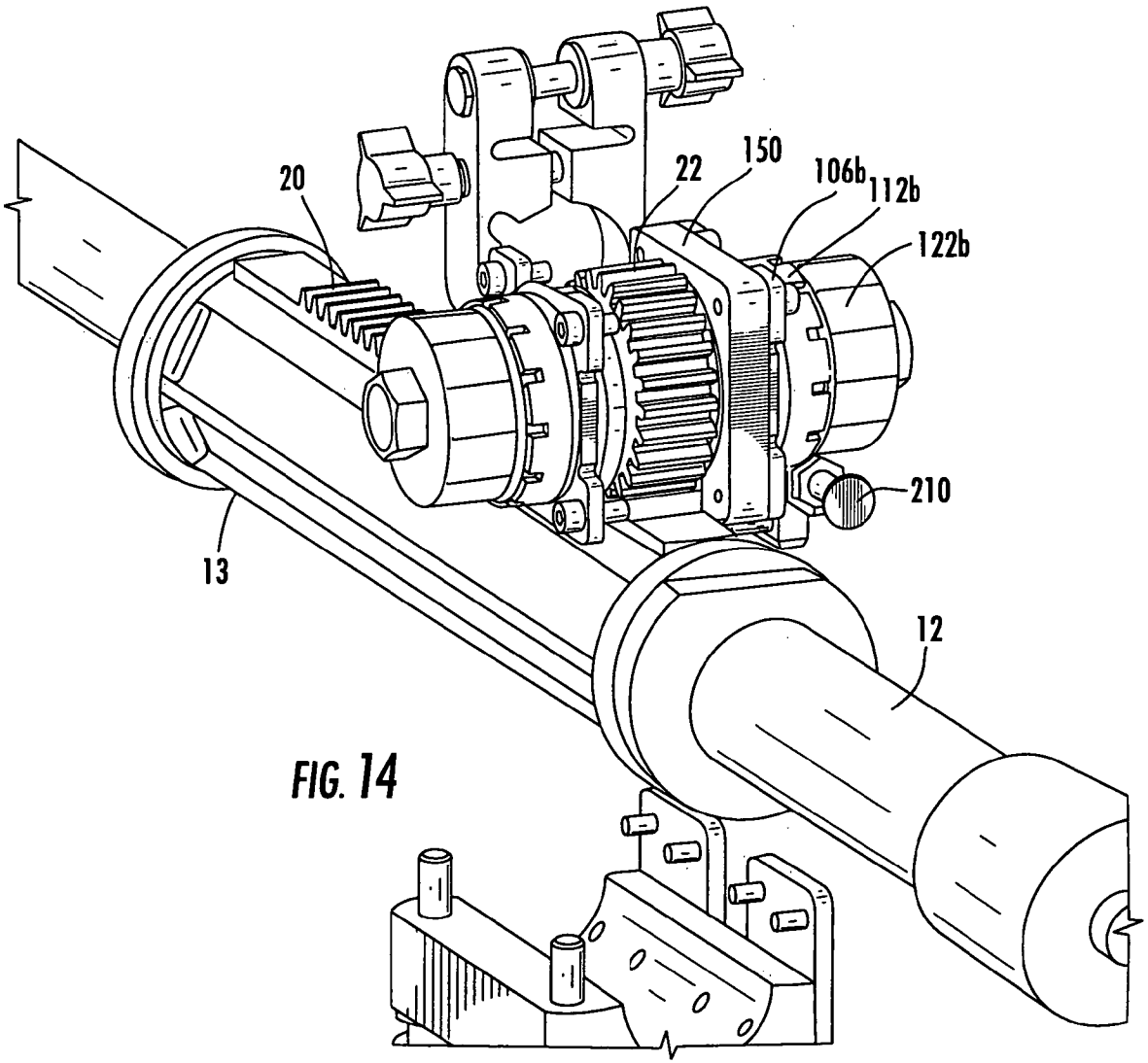

FIG. 9 also shows the position of sleeve 13 after firing. Pin 210 engages disk brake 106*b*. To slide sleeve 13 to the right in FIG. 9, pin 210 is pulled, FIG. 10. Now, all the shaft and brake components shown in FIG. 5 except the right hand side brake assembly are free to slide axially (to left in FIG. 5) until gear 22, FIG. 11 hits stop 220, FIG. 11. In this configuration, gear 22 is disengaged from gear rack 20 as shown in FIG. 12. Now sleeve 13, FIG. 13 can be slid forward (in the direction of arrow 19) in FIG. 13. Then, the brake assembly on the right side of FIG. 13 is pushed back in, FIG. 14, reengaging gear 22 with rack 20 and held in place by pin 210 which restricts movement of brake disk 106*b*. In this way, the settings of indicator rings 130*a* and 130*b*, and nuts 122*a* and 122*b*, FIGS. 5-11 are not disturbed, and yet, nuts 122*a* and 122*b* can be turned, if necessary, to a new setting with reference to the previous settings.

The subject invention also features another way to convert the translation of a weapon when fired into rotational motion and to arrest or resist the resulting rotational motion besides the gear rack, pinion gear, and braking subsystems discussed above.

Figure 15:
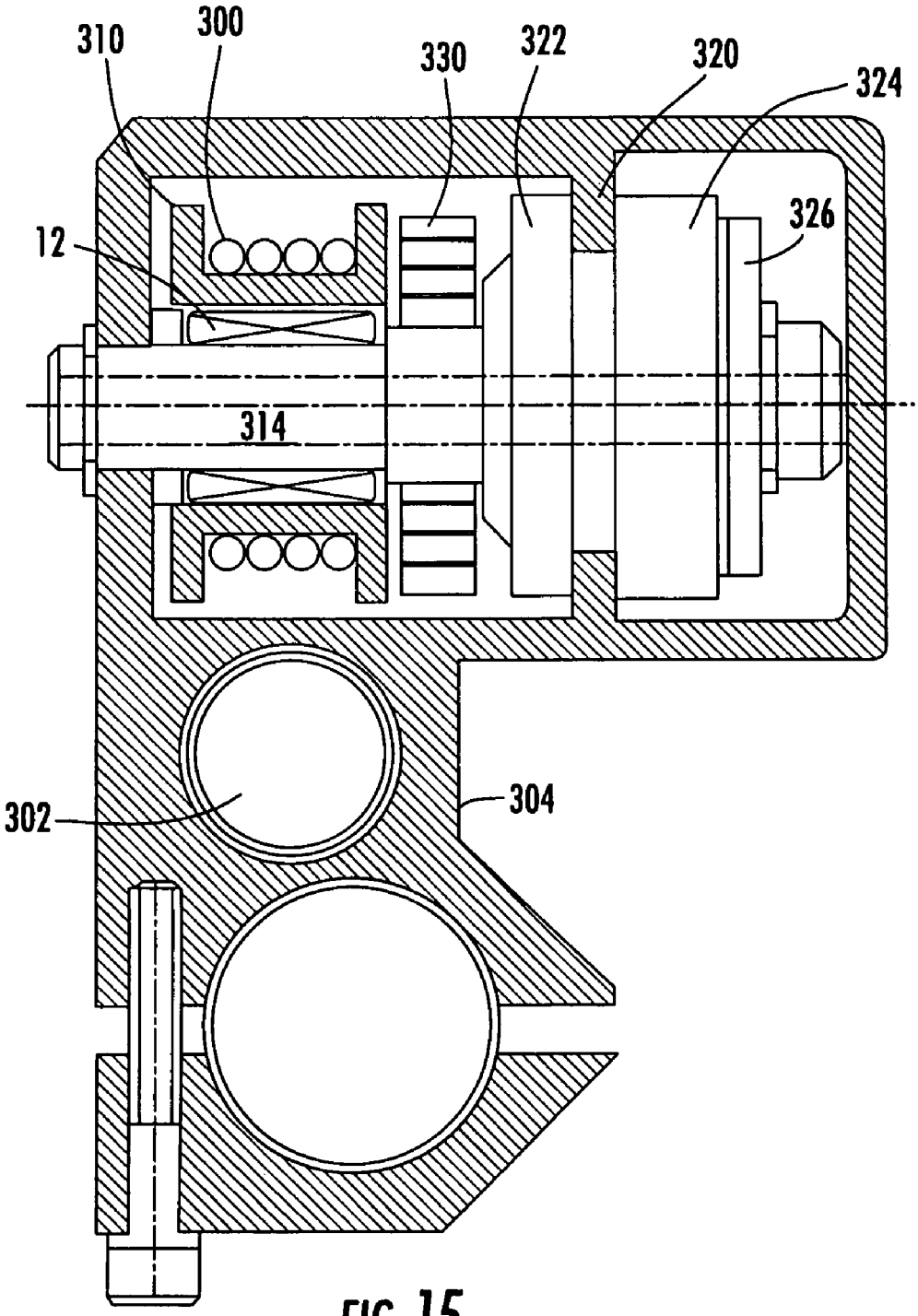
FIG. 15 is a schematic cross-sectional front view of another embodiment of a recoil mitigation weapon mount in accordance with the subject invention.

For example, FIG. 15 is a front view cross section like FIG. 5 which shows a conversion subsystem including cable 300 fixed on opposite ends to a weapon received in channel 302 of housing 304. One end of cable 300 is fixed with respect to a portion of the weapon forward of housing 304 and the other end of cable 300 is fixed with respect to a portion of the weapon rearward of housing 304. Again, a sleeve for the weapon may be provided as discussed above and the cable attached to opposite ends of the sleeve. Cable 300 is wound about drum 310 itself fixed to one way roller clutch assembly 312 on shaft 314 rotatably disposed in housing 304. The brakes subsystem for shaft 314 and thus drum 310 includes, in this example, housing brake disk portion 320 and brake shoe 322 on shaft 314. Friction brake 324, adjustable via nut 326, biases brake shoes 322 and 324 against brake disk 320. Roller clutch 312 and clock spring 330 about shaft 314 serve to return drum 310 and hence the weapon barrel to their pre-firing positions after firing. Upon firing, when the barrel translates in channel 302, cable 300 turns drum 310 which is braked via brake shoes 322 and 324 rubbing on disk brake 320. One suitable friction brake is the No. RFC-50 66-266 lb-in available from Ringfeder Corp. A suitable one-way roller clutch assembly is No. FCB-16 available from Torrington.

Other conversion subsystems and means configured to convert the translation of a weapon upon firing into rotational motion as well as other braking subsystems or means for resisting rotation of the conversion subsystem are within the scope of the subject invention. Also, in the preferred embodiments discussed above, the weapon shown is a disruptor and the recoil mitigation mount is configured to be coupled to a robot arm. Recoil mitigation devices for other weapons and mounts for structures other than a robot arm are also within the scope of this invention.

In accordance with the preferred embodiment discussed above, the mount is designed to attach a disrupter (various disrupters and de-armers) to the upper arm of a Talon (or other) robot such that the recoil energy from the shot (the rearward motion of the disrupter, or "canon") is dissipated gradually and in a controlled manner, thus protecting the robot arm, arm joints and other robot parts from damage due to the sudden shock of firing the disrupter.

Typically, the canon is securely held in the sleeve by one or more shoulders on the canon, or clamping collars on the barrel of the canon, or a combination of the two (depending on the design of the specific canon). The canon, hence the sleeve and gear rack also, slide rearward in the mount upon firing. The gear rack is engaged with a pinion gear which is caused to rotate when the canon-sleeve-and-rack recoil rearward.

Rotation of the pinion gear is resisted by one or more (two are preferred) spring-loaded friction brakes on the gear shaft. One embodiment uses two disk-type brakes (as opposed to drum brakes or centrifugal brakes, which could also be used), one on each end of the pinion shaft. The brakes are adjustable, by tightening a nut in each brake assembly, which compresses a stack of Belleville springs or other springs within the brake. The brake disks are affixed the body of the mount, and the brake hubs with brake pads rotate with the pinion shaft.

In practice, the sleeve/canon accelerates quickly (almost instantly) to a maximum velocity upon firing. Thereafter, the rearward recoil motion is resisted by the constant force on the gear rack provided by the friction brake(s) on the pinion shaft. Therefore, the rearward recoil velocity of the sleeve/canon is diminished in a nominally linear manner (constant deceleration) until the sleeve/canon comes to rest. During this deceleration period, the robot arm and the rest of the robot experience this constant force.

The typical initial recoil velocity of the sleeve/canon depends on the strength of the ammo load, the mass of the projectile, and the mass of the canon, sleeve, and rack (the rearward-moving mass). In practice this velocity can be up to 30-40 ft/sec, and the kinetic energy of recoil up to 2000-2500 inch-lbs.

The typical maximum recoil force (for the most energetic ammo round used with disrupters) which a robot like the Talon could repeatedly sustain would be in the range of 200-400 lbs force for a short period of time, on the order of 20-40 ms (milliseconds). If the brakes slip at a torque equivalent to 400 lbs linear force in the rack, and the available stroke of the sleeve in the mount is, say, six inches, the brakes would thus be able to dissipate up to 2400 inch-lbs of recoil energy without running out of stroke. If the sleeve should run out of stroke (if the brakes were set too light, for instance) the motion of the shouldered sleeve and canon would be arrested abruptly by the mount housing at the end of the stroke.

Various means may be employed to allow the sleeve/canon to return to the starting forward position for the next shot. A one-way roller or "sprag" type clutch can be placed between the pinion gear and its shaft, thereby allowing the sleeve/rack to slide forward freely, but slide rearward only by slipping the brake(s). Another option is to simply loosen the adjusting nut on the brake(s) until the brakes will slip freely. Still a third option, discussed above, is to mechanically disengage the pinion gear from the gear rack by temporarily sliding the pinion and shaft axially in the mount housing. Other options are also possible and all are within the scope of the invention.

Because the sleeve represents the only interface between the canon and the recoil absorbing mount, it is only necessary to change the configuration of the sleeve details (not the mount/housing/brakes, etc.) to accommodate almost any disrupter from any manufacturer. Thus the invention is considered to be a universal disrupter mount in principle and in fact.

Other features included in the mount design are a provision to attach a laser aiming device or a robot camera on the disrupter mount thus providing a remote robot operator with a "boresight" view of the target and means to adjust the camera position for optimum view.

Benchmarks and numbered markings on the brake adjusting nut(s) (see indicia 202*b*, FIG. 7) permit pre-setting the brakes (based on a calibration curve) to a desired friction value for the ammo round being used, and to facilitate controlled brake adjustments between shots.

Also, clamps 50*a* and 50*b* serve to rapidly attach and detach the disrupter mount to the robot arm using quick-clamp/release clamps. In addition, the mount can be repositioned with or without canon, to the side of the robot arm in order to facilitate stowage of the robot without removing the mount and disrupter.

In any embodiment, the subject invention is a new recoil mitigation weapon mount for a robot or other structure in order to prevent damage to the robot or structure and/or to prevent damage to various components of the weapon. Preferably, the muzzle velocity of the round used in the weapon is not reduced. The preferred weapon mount is adjustable and more universal in design.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A mobile remotely controlled robot comprising:

a robot platform;

a robot arm maneuverable with respect to the robot platform;

a housing configured to be removably mounted to the robot arm;

a sleeve translatable with respect to the housing for receiving a weapon therein;

a gear rack on the sleeve;

a pinion gear rotatably disposed in the housing and engaged with the gear rack; and a braking subsystem for resisting rotation of the pinion gear when the gear rack translates upon firing of the weapon.

2. The robot of claim 1 in which the housing includes a channel therethrough which receives the sleeve and the gear rack.

3. The robot of claim 1 in which the housing includes a clamping mechanism securable to the robot arm.

4. The robot of claim 1 in which the braking subsystem includes:

a shaft fixed to the pinion gear and rotatable with respect to the housing, a brake disk fixed to the housing, a brake hub fixed to the shaft and having a shoe portion adjacent one side of the brake disk, a translatable brake shoe adjacent an opposite side of the brake disk, and means for biasing the translatable brake shoe.

5. The robot of claim 4 in which there is a first brake pad between the shoe portion of the brake hub and the brake disk and a second brake pad between the translatable brake shoe and the brake disk.

6. The robot of claim 4 in which the means for biasing includes a plurality of Belleville springs about the brake hub adjacent the translatable brake shoe and a nut securable to the brake hub adjustable to bear upon the Belleville springs.

7. The robot of claim 6 further including an indicator ring settable with respect to the translatable brake shoe to mark the position of the nut on the brake hub.

8. The robot of claim 4 further including means for disengaging the pinion gear from the gear rack.

9. The robot of claim 8 in which the means for disengaging includes:

a carrier for the brake disk, and a mechanism for locking the carrier with respect to the housing.

10. The robot of claim 9 in which the mechanism includes a pin.

* * * * *